United States Patent [19]

Folsberg

[11] Patent Number: 4,715,544

[45] Date of Patent: Dec. 29, 1987

[54] VERTICAL ROLLER MILL

[75] Inventor: Jan Folsberg, Copenhagen, Denmark

[73] Assignee: F. L. Smidth & Co. A/S, Copenhagen, Denmark

[21] Appl. No.: 924,619

[22] Filed: Oct. 29, 1986

[30] Foreign Application Priority Data

Oct. 29, 1985 [GB] United Kingdom ..... 8526626

[51] Int. Cl.[4] ..... B02C 15/00

[52] U.S. Cl. ..... 241/57; 241/119

[58] Field of Search ..... 241/80, 97, 117–121, 241/79.1, 40, 53, 57

[56] References Cited

U.S. PATENT DOCUMENTS 3,774,854 11/1973 Poeschl ..... 241/117 X 4,234,132 11/1980 Maliszewski ..... 241/119 X

*Primary Examiner*—Mark Rosenbaum

*Attorney, Agent, or Firm*—Brumbaugh, Graves, Donohue & Raymond

[57] ABSTRACT

A vertical roller mill has stationary grinding rollers which roll over a grinding path (4) of a rotatable grinding table (1), and a surrounding nozzle ring (7) for conveying and separating air. A coarse fraction of ground material is entrained upwards and radially inwards over an inclined outer wall (19) of a screen (15) and is directed downwards by an overlying guide wall (16) onto an inclined inner wall (20) of the screen (15) and hence back to the grinding table (1) for further grinding.

4 Claims, 4 Drawing Figures

VERTICAL ROLLER MILL

The invention relates to a vertical roller mill (hereinafter referred to as of the kind described) comprising a grinding table which is rotatable about a vertical axis; at least two grinding rollers which are rotatable about substantially horizontal, stationary axes, and are urged against an annular grinding path of the grinding table; and a nozzle ring encircling the table for blowing separating and conveying, and possibly drying, gas into a mill housing above the grinding table.

In known mills of the above kind, material, having been ground on the grinding table, moves outwards under centrifugal force, owing to the rotation of the grinding table, over the nozzle ring, from where the material is blown upwards and inwards to the area above the grinding table by the gas stream from the nozzle ring. Finer particle fractions of ground material are suspended in the conveying gas and carried upwards inside the mill housing into a separator at the top of the mill, or out of the mill into a separate separator, while coarser particle fractions, too heavy to remain suspended in the conveying air, fall down onto the grinding table again.

In the separator, the material entrained by the conveying gas is sorted into a further coarse fraction which is returned to the grinding table for renewed grinding, and into a fine fraction of finish ground material which is led away for further treatment or storage.

However, the coarser particle fractions, too heavy to remain suspended in the conveying air, do not all fall down onto the grinding path proper or the grinding table, but will fall down on other parts of the nozzle ring to be blown up again from the latter into the area above the grinding table. In this way a lot of material can be blown to and fro above the grinding table without landing on its grinding path for renewed grinding, which reduces the mill efficiency and particularly causes increased and unnecessary energy consumption.

It is the object of the invention to overcome these drawbacks and in accordance with the invention in a vertical roller mill of the kind described, a screen is mounted above the grinding path in each circular arc between adjacent rollers, the screen being formed with an obliquely upwardly and radially inwardly directed outer wall above a radially outer zone of the grinding path and an obliquely downwardly and radially inwardly directed inner wall above a radially inner zone of the grinding path; and a guide wall is mounted above each screen, the guide wall being formed and placed to collect material being blown, in use, by the gas from the nozzle ring over and along the outer screen wall and to return at least a coarser fraction of this material down towards the inner screen wall and hence back onto the grinding table adjacent to the radially inner edge of the grinding path.

The screen prevents the material blown over the grinding table from falling down randomly on the grinding path, while the guide wall collects and stops the material flow over the screen and leads it down towards the obliquely downwardly and inwardly directed inner screen wall, which further leads the material down towards the inner edge of the grinding path wherefrom the material, owing to centrifugal force, is led outwards over the grinding path again for renewed grinding.

By the above combination of screen and guide wall it is possible to control precisely the material movement from the nozzle ring back to the grinding path of the grinding table. Additionally, there is achieved a reduced power consumption for the conveying gas flow inside the mill housing, and, furthermore an improved preseparation of the material particles at the nozzle ring due to the reduced material load over the nozzle ring.

The guide wall may be a part cyclone wall opening towards the screen, whereby such part of the material and the conveying gas stream flowing into this part cyclone wall are given a cyclonic movement, at least as regards finer material particles.

There is thus also obtained a preseparation of material particles in and at the guide wall as the coarsest particle fractions move along the part cyclone wall down towards the screen, while the less coarse particle fractions continue the cyclonic movement until they cross the upwardly moving gas flow.

Within the part cyclone wall there may be mounted an impact plate, the impact plate being arranged to direct the material/gas suspension blown into the part cyclone wall into the upper part of the part cyclone wall.

In this way the material/gas suspension is deflected upwards before reaching the curved part cyclone wall, which also causes a preseparation of the material particles as a part of the gas with finer particles by-passes the part cyclone wall, while the majority of the coarser particles proceed towards the part cyclone wall.

The invention is now described in more detail by the way of an example of a mill according to the invention and with reference to the accompanying drawing, in which.

Figure 1:
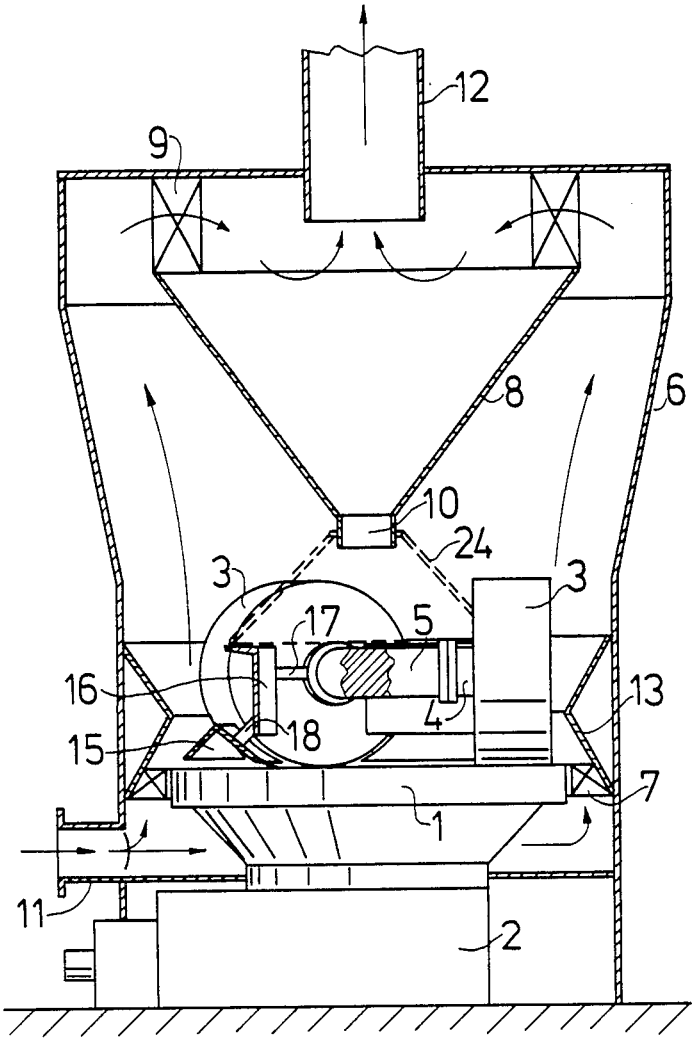
FIG. 1 is a diagrammatical elevation of a part of the mill partly in vertical section.
Figure 2:
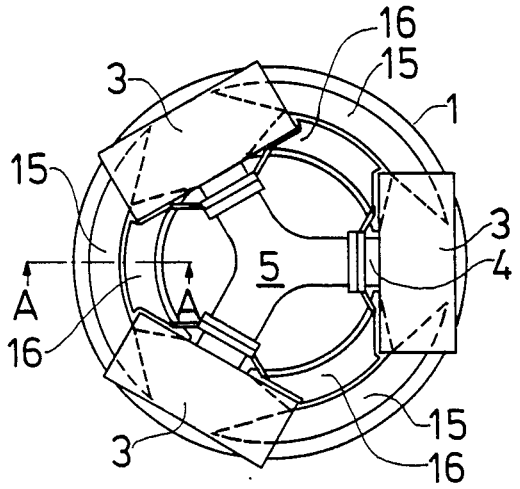
FIG. 2 is a top view of the grinding table and grinding rollers of the mill.

The mill has a grinding table 1 rotating about a vertical axis supported by a driven via a gear 2 by a conventional motor (not shown). Resting and rolling on the grinding table 1 are grinding rollers 3, in this example three grinding rollers, for grinding a material layer on the grinding table. Each roller 3 is mounted on a fixed shaft 4 which, together with the shafts of the other rollers, is attached to a common, central frame 5.

The shafts 4 are prevented from moving in the direction of rotation of the grinding table, e.g. by not shown horizontal draw bars, which at one end may be secured to the shafts 4 and at the other to a mill housing 6. The grinding rollers may be urged against the grinding table 1 by conventional, generally vertical draw bars (not shown), e.g. with conventional hydraulic cylinders (not shown) anchored in the mill foundation, forcing the rollers down against the grinding table.

A nozzle ring 7 encircles the grinding table, and above the grinding table 1 and the frame 5 is mounted a stationary separator 8 having, at its top, adjustable louvre inlets 9 for a material/gas suspension, and, at its bottom, an outlet 10 for coarse material precipitated in the separator.

Separating, conveying, and possibly also drying, gas to the mill is fed at the bottom of the housing 6 through a gas supply duct 11 into a chamber below the grinding table and the nozzle ring. Spent gas with entrained fine material, i.e. material sufficiently ground in the mill, is discharged from the mill through an outlet 12 at the top of the separator 8. Above the nozzle ring 7 is mounted a gas guide cone 13 to direct conveying gas flowing up through the nozzle ring 7 obliquely inwards and upwards over the grinding table 1.

Over the grinding path 14 along the outer, annular zone of the grinding table, against which the grinding rollers 3 roll and in each circular arc between adjacent rollers, is mounted a screen 15, and above this screen is mounted a guide wall 16, 21.

The guide wall 16, 21 and the screen 15 may be secured to the frame 5 by bars 17 and 18.

The screen comprises, as seen in axial section, an obliquely upwardly and radially inwardly directed outer wall 19, and an obliquely downwardly and radially inwardly directed inner wall 20, and the guide wall 16, 21 is formed with a concave side facing the screen 15.

Figure 3:
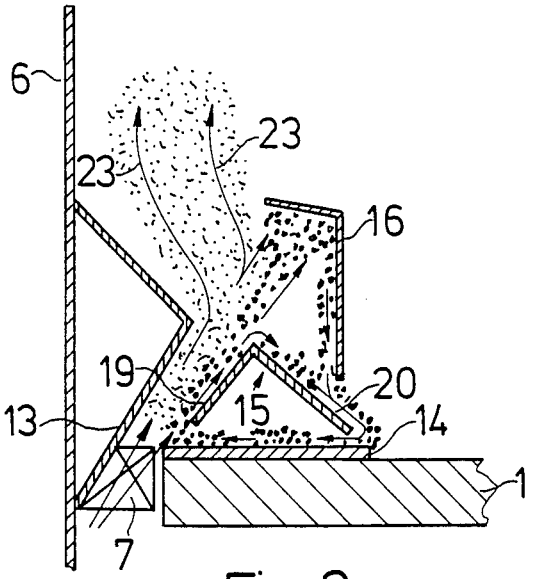
FIG. 3 is and section of a detail of the mill taken on the line A—A in FIG. 2 illustrating one form of screen and guide wall for the mill; and, FIG. 4 a section similar to that in FIG. 3, but of a modification of screen and guide wall.
Figure 4:
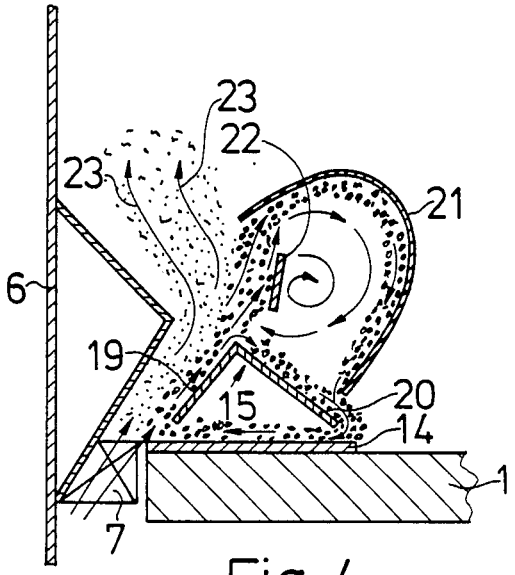

The guide wall 16, 21 may either have an angular profile, as at 16 in FIG. 3, or be formed as a curved part cyclone wall, as at 21 in FIG. 4, with an impact plate 22 mounted in its concave side.

The screen 15 and the guide wall 16 in FIG. 3 operate in the following way. Owing to the centrifugal forces, the material ground on the rotating grinding table 1 moves outwards towards the nozzle ring 7. Conveying gas is blown through the nozzle ring 7 and entrains the material up through the slot between the outer wall 19 of the screen 15 and the guide cone 13. Finer fractions of the material are suspended in the conveying gas and conveyed further up in the mill as indicated by arrows 23, while the coarser fractions are blown upwards and inwards to the central area of the mill housing along the wall 19 of the screen 15 to be caught by the inner side of the guide wall 16. Here the coarser fractions are stopped and led down along the vertical part of the guide wall 16 towards the inner wall 20 of the screen 15. From there the material is passed down towards the radially inner edge of the grinding path 14 of the grinding table 1 and moves under centrifugal force outwards over the grinding path for renewed grinding.

In the modification according to FIG. 4, the coarser fractions blown up along the wall 19 of the screen 15, by the conveying gas from the nozzle ring 7, hit the impact plate 22 before they reach the inner side of the guide wall 21. As a result, the flow of the coarser fractions is directed up towards the outer and upper part of the guide wall, whereby part of the gas and the coarser particles is forced to follow the curvature of the wall 21, while the other part of the gas with less coarse particles by-passes the guide wall 21.

The coarser particles pass down along the guide wall to the inner wall 20 of the screen 15 and further down towards the grinding table, while finer particles and gas continue the cyclonic movement out between the lower end of the impact plate 22 and the top of the screen 15 and the reenter the upwardly moving gas flow 23 from the nozzle ring, causing yet another preseparation of particles, whereupon the remaining finer particles are conveyed with the conveying gas up to the separator 8.

To prevent gas from flowing inwards towards the central area of the mill housing between the screens 15 and the guide walls 16, 21 or the grinding path 14, respectively, and consequently counteract the predetermined movement of the material down towards the inner edge of the grinding path and hence outwards over the latter, another screen or shield 24 may be mounted over the guide walls as indicated by dotted lines in FIG. 1.

I claim:

1. In a vertical roller mill comprising a grinding table which is rotatable about a vertical axis; at least two grinding rollers which are rotatable about substantially horizontal, stationary axes and are urged against an annular grinding path of said grinding table; and a nozzle ring encircling said table for blowing separating and conveying gas into a mill housing above said grinding table; the improvement wherein a screen is mounted above said grinding path in each circular arc between adjacent ones of said rollers, said screen being formed with an obliquely upwardly and radially inwardly directed outer wall above a radially outer zone of said grinding path and an obliquely downwardly and radially inwardly directed inner wall above a radially inner zone of said grinding path; and wherein a guide wall is mounted above each said screen, said guide wall being formed and placed to collect a portion of material being blown, in use, by the gas from said nozzle ring over and along said outer screen wall and to return at least a coarser fraction of said material down towards said inner screen wall and hence back onto said grinding table adjacent to the radially inner edge of said grinding path, said screen and guide wall being further placed and formed such that there is an annular space between said guide wall and said mill housing and such that, in use, said separating and conveying gas suspends at least a finer fraction of said material being blown and conveys said at least finer fraction upwardly through said annular space and past said guide wall.

2. A mill according to claim 1, wherein said guide wall is shaped as a part cyclone wall, a concave side of which faces towards said screen.

3. A mill according to claim 2, wherein an impact plate is mounted within said part cyclone wall, said impact plate being arranged to direct the material/gas mixture blown into said part cyclone wall into the upper part thereof.

4. A mill according to claim 1, wherein there is a shield mounted over said guide walls to inhibit gas from flowing into the central area of said mill housing.

* * * * *